US012571306B1

(12) United States Patent
Smarandache et al.

(10) Patent No.: US 12,571,306 B1
(45) Date of Patent: Mar. 10, 2026

(54) PRESSURE COMPENSATED LOCKING SAMPLING TOOL

(71) Applicant: Schlumberger Technology Corporation, Sugar Land, TX (US)

(72) Inventors: Marius Smarandache, Rosharon, TX (US); Guillaume Louche, Rosharon, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/828,868

(22) Filed: Sep. 9, 2024

(51) Int. Cl.
*E21B 49/08* (2006.01)

(52) U.S. Cl.
CPC ..... *E21B 49/082* (2013.01); *E21B 49/087* (2013.01)

(58) Field of Classification Search
CPC ..... E21B 49/082
See application file for complete search history.

(56) References Cited

U.S. PATENT DOCUMENTS

| | | | | |
|---|---|---|---|---|
| 5,058,674 | A * | 10/1991 | Schultz | E21B 49/082 166/264 |
| 5,337,822 | A * | 8/1994 | Massie | E21B 49/082 166/321 |
| 6,216,782 | B1 * | 4/2001 | Skinner | E21B 49/081 73/152.28 |
| 7,191,672 | B2 * | 3/2007 | Ringgenberg | G01N 33/2823 73/152.23 |
| 7,671,983 | B2 * | 3/2010 | Shammai | G01N 33/2823 356/301 |
| 9,771,798 | B2 * | 9/2017 | Gilbert | E21B 49/081 |
| 10,487,652 | B2 * | 11/2019 | Smarandache | E21B 34/08 |
| 10,669,847 | B2 * | 6/2020 | Smarandache | E21B 49/082 |
| 10,677,053 | B2 * | 6/2020 | Jaramillo | E21B 49/0875 |
| 2004/0218176 | A1 * | 11/2004 | Shammal | G01N 21/65 356/326 |
| 2016/0168989 | A1 * | 6/2016 | Gilbert | E21B 49/081 166/264 |
| 2017/0175525 | A1 * | 6/2017 | Smarandache | E21B 49/082 |
| 2017/0254198 | A1 * | 9/2017 | Dybdahl | E21B 49/081 |
| 2017/0260856 | A1 * | 9/2017 | Crabeil | E21B 47/06 |
| 2018/0051560 | A1 * | 2/2018 | Smarandache | E21B 34/08 |
| 2018/0058213 | A1 * | 3/2018 | Jaramillo | E21B 49/081 |

FOREIGN PATENT DOCUMENTS

| | | | | |
|---|---|---|---|---|
| CN | 107420099 A | * | 12/2017 | E21B 49/082 |
| CN | 112539058 A | * | 3/2021 | E21B 49/088 |
| FR | 2741665 A1 | * | 5/1997 | E21B 49/082 |

* cited by examiner

*Primary Examiner* — Jennifer H Gay
(74) *Attorney, Agent, or Firm* — Jeffrey D. Frantz

(57) ABSTRACT

A method for sampling wellbore fluid, including: lowering a sampling tool into a wellbore, configuring the sampling tool in an open configuration, retrieving a sample of wellbore fluid from the wellbore in a sampling chamber, retaining the sampling tool in an open configuration with a locking mechanism, configuring the sampling tool in a closed configuration, retaining the sampling tool in the closed configuration, and pressurizing the sample with a pressurized fluid in the pressurized chamber. Configuring the sampling tool in the open configuration includes opening fluid communication between the sampling chamber of the sampling tool and the wellbore. Configuring the sampling tool in the closed configuration includes closing fluid communication between the sampling chamber and the wellbore and opening fluid communication between the sampling chamber and the pressurized chamber.

20 Claims, 10 Drawing Sheets

PRESSURE COMPENSATED LOCKING SAMPLING TOOL

BACKGROUND

Wellbore fluid samples are often taken during oil and gas wellbore operations to evaluate well fluid and geologic formation parameters. Taking the sample of wellbore fluid involves deploying a sampling tool downhole into a wellbore and drawing a sample of the wellbore fluid into the tool. A variety of pistons and/or other devices may be used in the sampling tool to intake the fluid sample. However, problems can arise during sampling because, occasionally, sampling tools prematurely open or close during sample operations. Furthermore, problems in analysis of the sampled wellbore fluid can arise when samples of wellbore fluid are not pressurized during retrieval of the sample.

SUMMARY

According to one or more embodiments, a method for sampling wellbore fluid, including: lowering a sampling tool into a wellbore, configuring the sampling tool in an open configuration, retrieving a sample of wellbore fluid from the wellbore in a sampling chamber, retaining the sampling tool in an open configuration with a locking mechanism, configuring the sampling tool in a closed configuration, retaining the sampling tool in the closed configuration, and pressurizing the sample with a pressurized fluid in the pressurized chamber. Configuring the sampling tool in the open configuration includes opening fluid communication between the sampling chamber of the sampling tool and the wellbore. Configuring the sampling tool in the closed configuration includes closing fluid communication between the sampling chamber and the wellbore and opening fluid communication between the sampling chamber and the pressurized chamber.

According to one or more embodiments, a method for sampling wellbore fluid, comprising: lowering a sampling tool into a wellbore, the sampling tool comprising a sampling chamber, a pressurized chamber, a rod partially disposed in the sampling chamber and partially disposed in the pressurized chamber, and a locking mechanism disposed between sampling chamber and the pressurized chamber; opening the sampling chamber, wherein opening the sampling chamber comprises moving the rod to a first position to open fluid communication between the wellbore and the sampling chamber, and wherein when the rod is in the first position, fluid communication between the pressurized chamber and the sampling chamber is blocked and the locking mechanism is in a first configuration retaining the rod in the first position; retrieving a sample of a wellbore fluid; closing the sampling chamber, wherein closing the sampling chamber comprises moving the rod to a second position to close fluid communication between the wellbore and the sampling chamber, and wherein when the rod is in the second position, fluid communication between the pressurized chamber and the sampling chamber is permitted and the locking mechanism is in a second configuration retaining the rod in the second position; and pressurizing the sample of fluid from the wellbore with a pressurized fluid from the pressurized chamber.

According to one or more embodiments, a wellbore fluid sampling tool, comprising: a sampling chamber in selective fluid communication with a pressurized chamber, a rod disposed in the tool, wherein the rod is movable between a first position and a second position, and a 2 position rod locking mechanism disposed between the chambers, wherein in a first locking position the rod is retained in the first position, and in the second locking position, the rod is retained in the second position. When the rod is in the first position, the sampling chamber is open to wellbore fluid and fluid communication between the chambers is closed. When the rod is in the second position, the sampling chamber is closed to wellbore and fluid communication between the chambers is open.

BRIEF DESCRIPTION OF DRAWINGS

So that the manner in which the above-recited features of the disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

The disclosure contemplates that terms such as "couples," "coupling," "couple," and "coupled" may include but are not limited to welding, interference fitting, and/or fastening such as by using bolts, threaded connections, pins, clips, and/or screws. The disclosure contemplates that terms such as "couples," "coupling," "couple," and "coupled" may include but are not limited to integrally forming. The disclosure contemplates that terms such as "couples," "coupling," "couple," and "coupled" may include but are not limited to direct coupling and/or indirect coupling, such as indirect coupling through components such as links.

Aspects of the present disclosure provide systems, apparatus, and methods for sampling a wellbore fluid with a sampling tool. The present disclosure generally relates to a wellbore fluid sampling tool including a movable rod, a sampling chamber and a locking mechanism, the tool movable between an open configuration and a closed configuration. In the open configuration the rod opens the sampling chamber to sample wellbore fluid and the locking mechanism retains the rod in the open position. In the closed configuration, the rod closes the sampling chamber to wellbore fluid but opens the sampling chamber to fluid communication with pressurized fluid to pressurize the sample. In the closed configuration, the locking mechanism retains the rod in the closed position.

Figure 1:
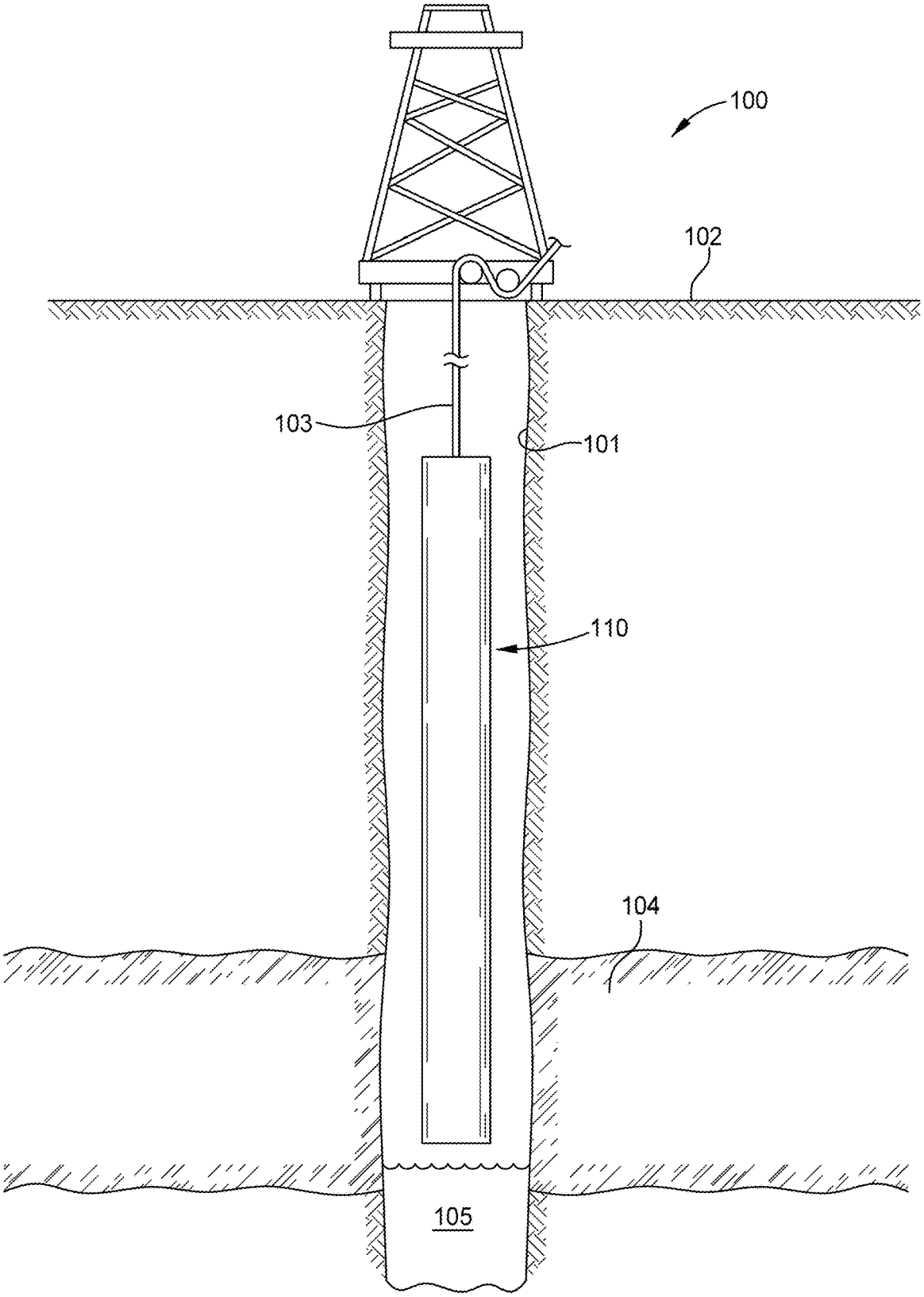
FIG. 1 illustrates a schematic view of an exemplary sampling system.
Figure 2A:
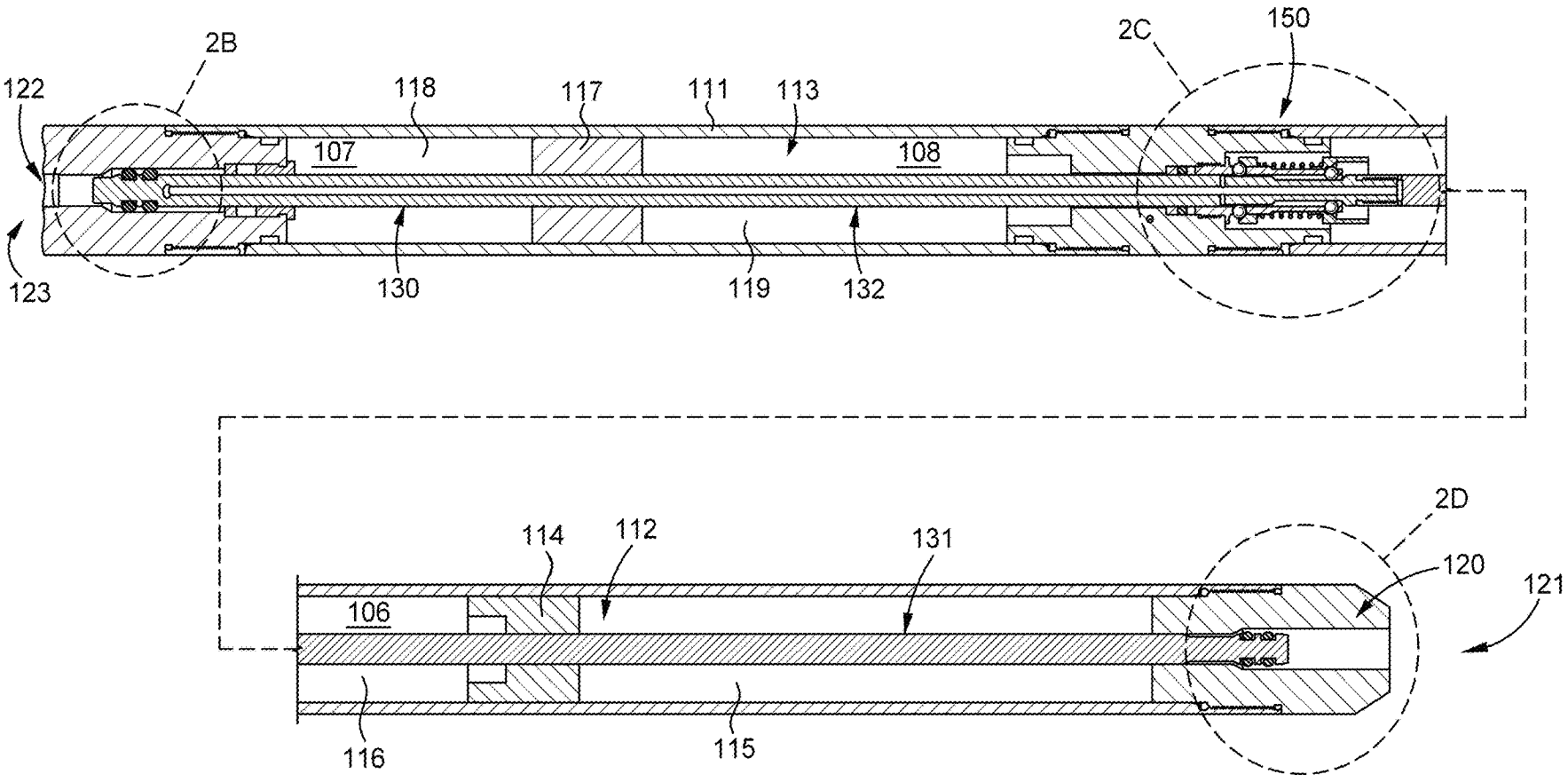
FIG. 2A illustrates a cross-sectional view a sampling tool, according to one or more embodiments.
Figures 2B, 2C, 2D:
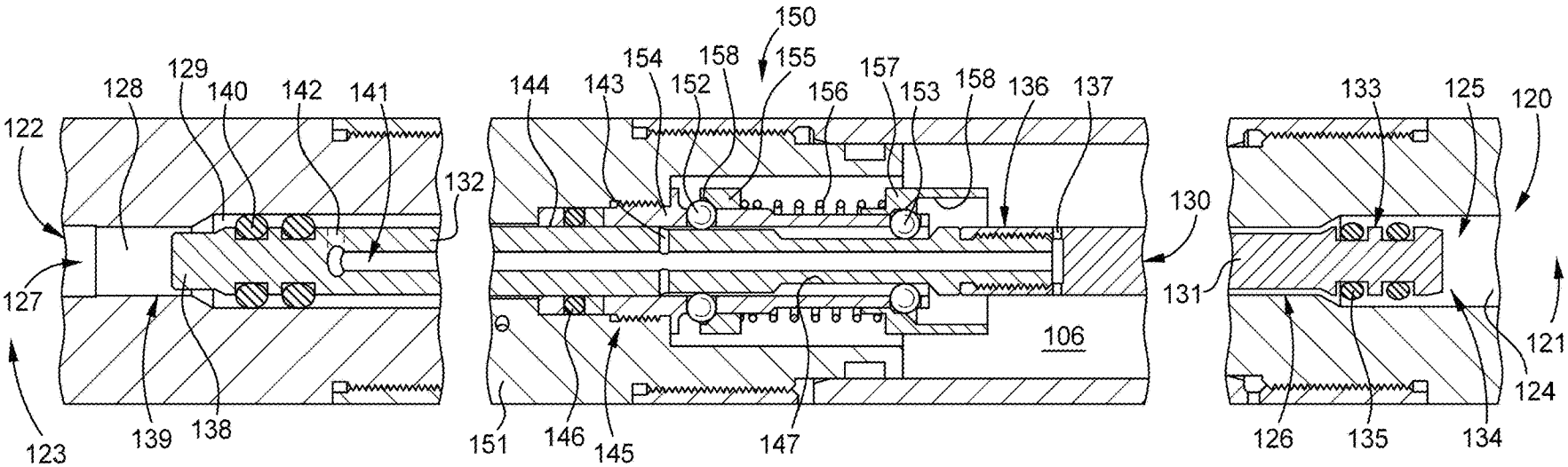
FIG. 2B illustrates a detailed cross-sectional view of a portion of the sampling tool of FIG. 2A.
FIG. 2C illustrates another detailed cross-sectional view of another portion of the sampling tool of FIG. 2A.
FIG. 2D illustrates another detailed cross-sectional view of another portion of the sampling tool of FIG. 2A.
Figure 3A:
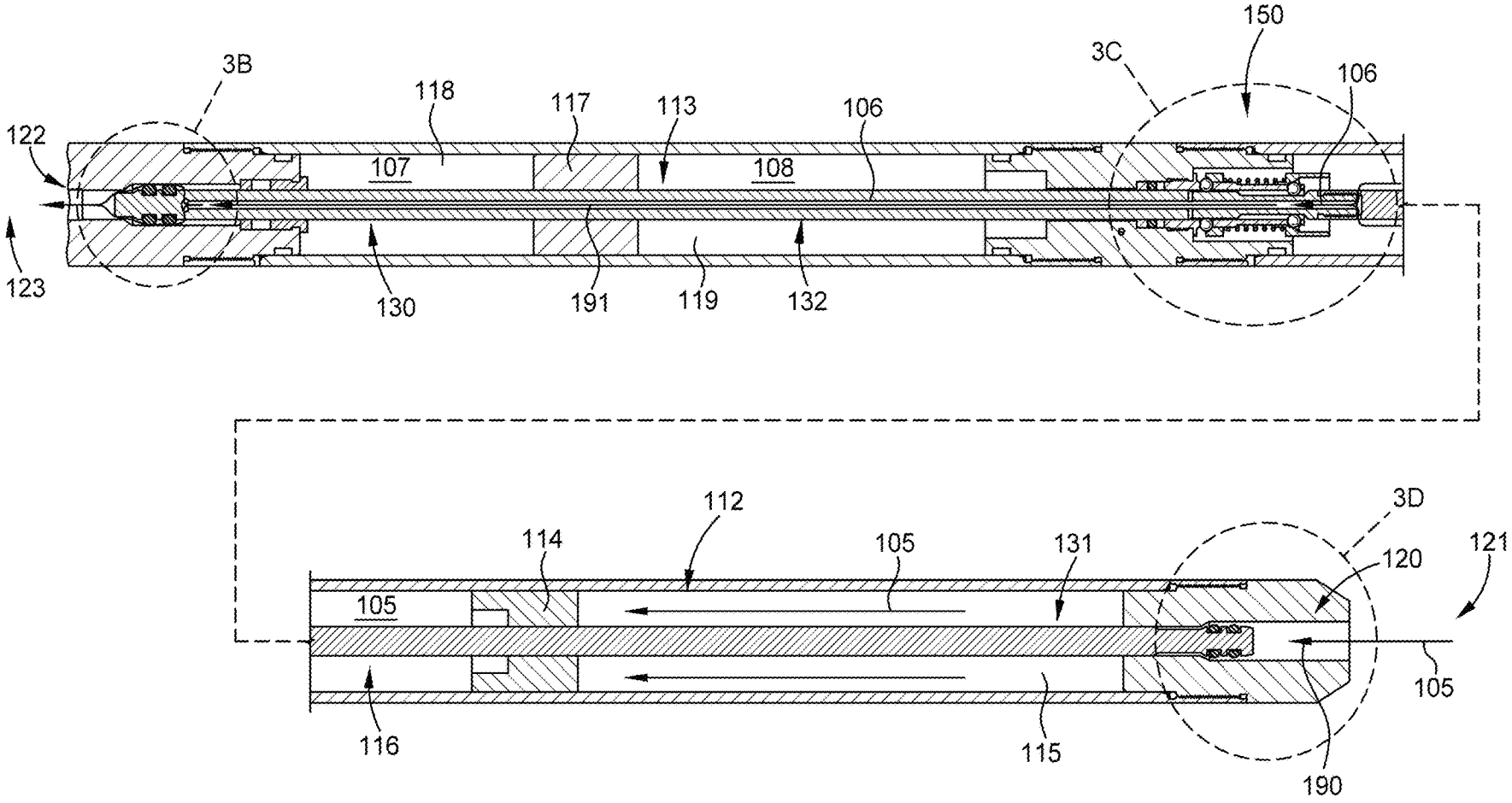
FIG. 3A illustrates a cross-sectional view of the sampling tool of FIG. 2A in a sampling configuration, according to one or more embodiments.
Figures 3B, 3C, 3D:
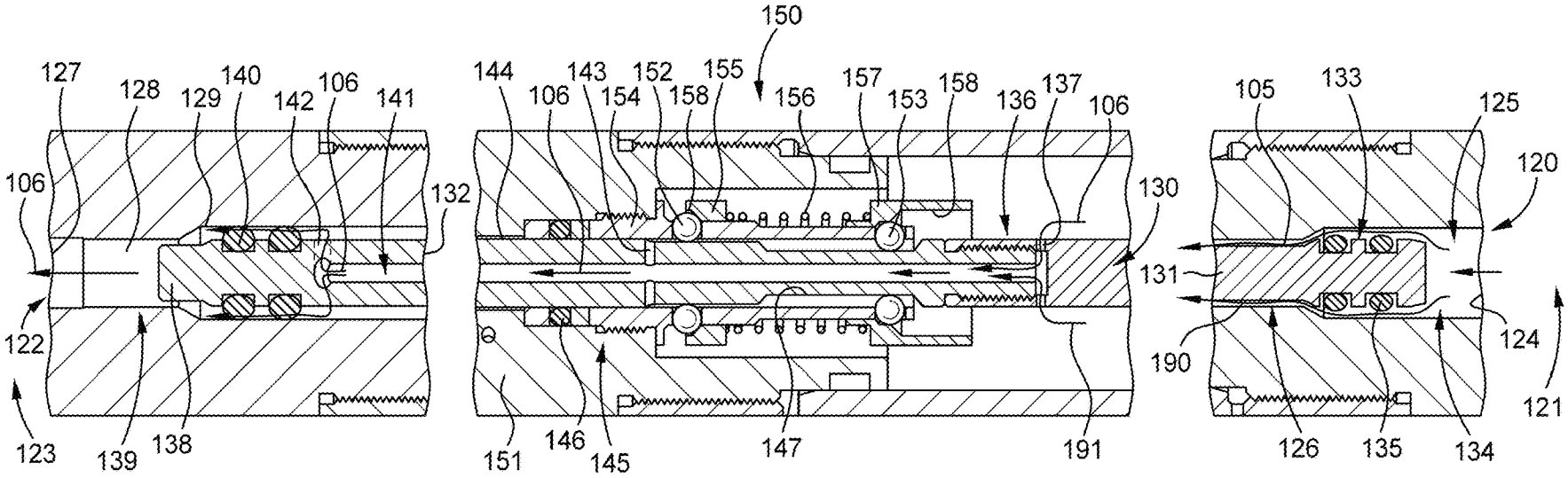
FIG. 3B illustrates a detailed cross-sectional view of a portion of the sampling tool of FIG. 3A, according to one or more embodiments.
FIG. 3C illustrates another detailed cross-sectional view of another portion of the sampling tool of FIG. 3A, according to one or more embodiments.
FIG. 3D illustrates another detailed cross-sectional view of another portion of the sampling tool of FIG. 3A, according to one or more embodiment's
Figure 4A:
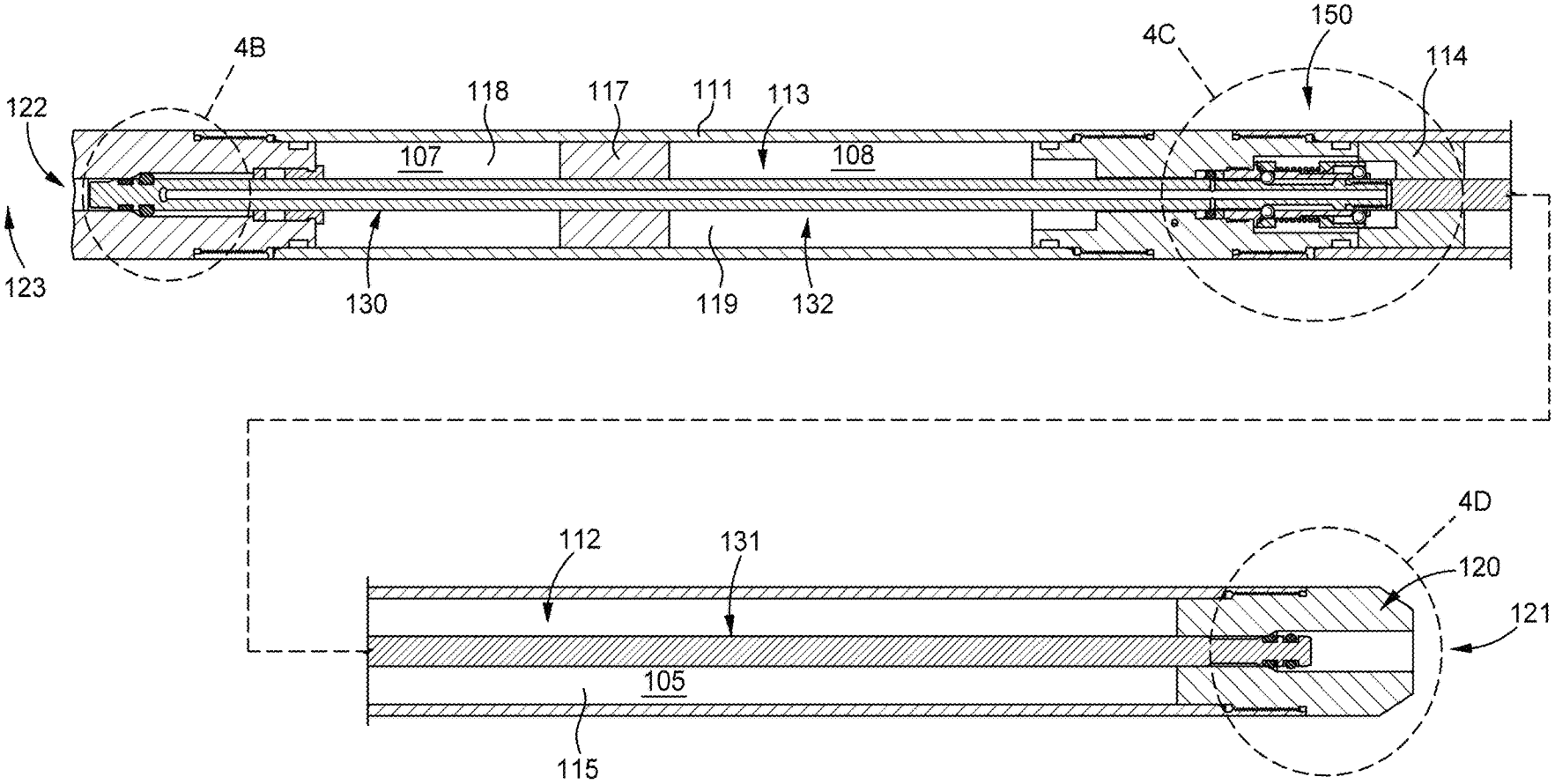
FIG. 4A illustrates a cross-sectional view of the sampling tool of FIG. 2A in a closed configuration, according to one or more embodiments.
Figure 4D:
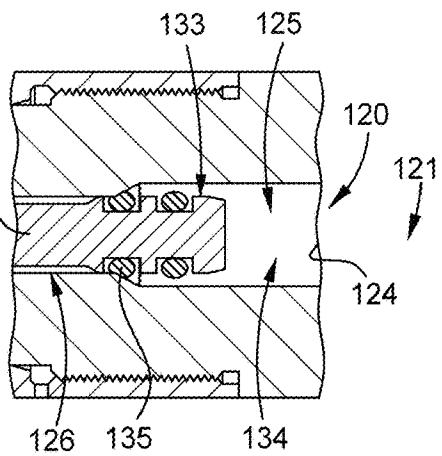
FIG. 4D illustrates another detailed cross-sectional view of another portion of the sampling tool of FIG. 4A, according to one or more embodiments.
Figure 4C:
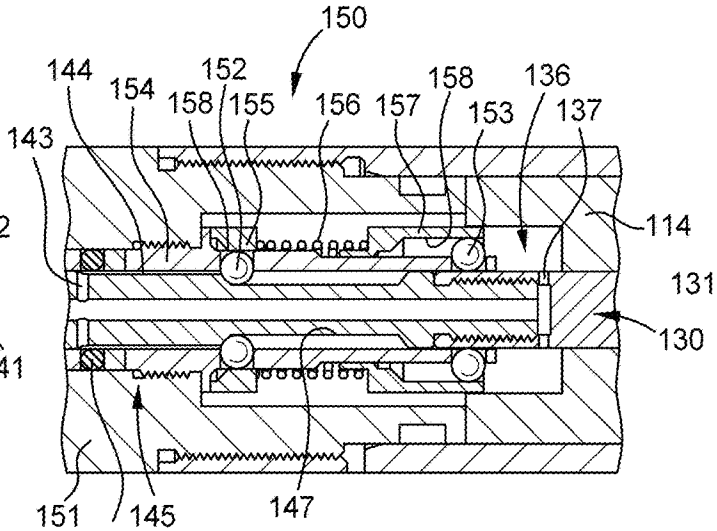
FIG. 4C illustrates another detailed cross-sectional view of another portion of the sampling tool of FIG. 4A, according to one or more embodiments.
Figure 4B:
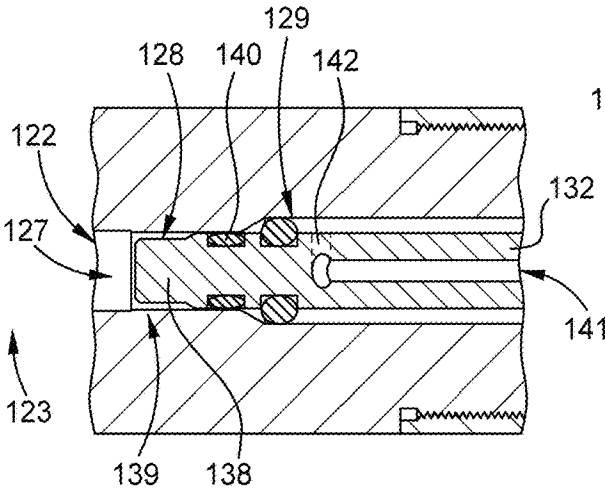
FIG. 4B illustrates a detailed cross-sectional view of a portion of the sampling tool of FIG. 4A, according to one or more embodiments.
Figure 5A:
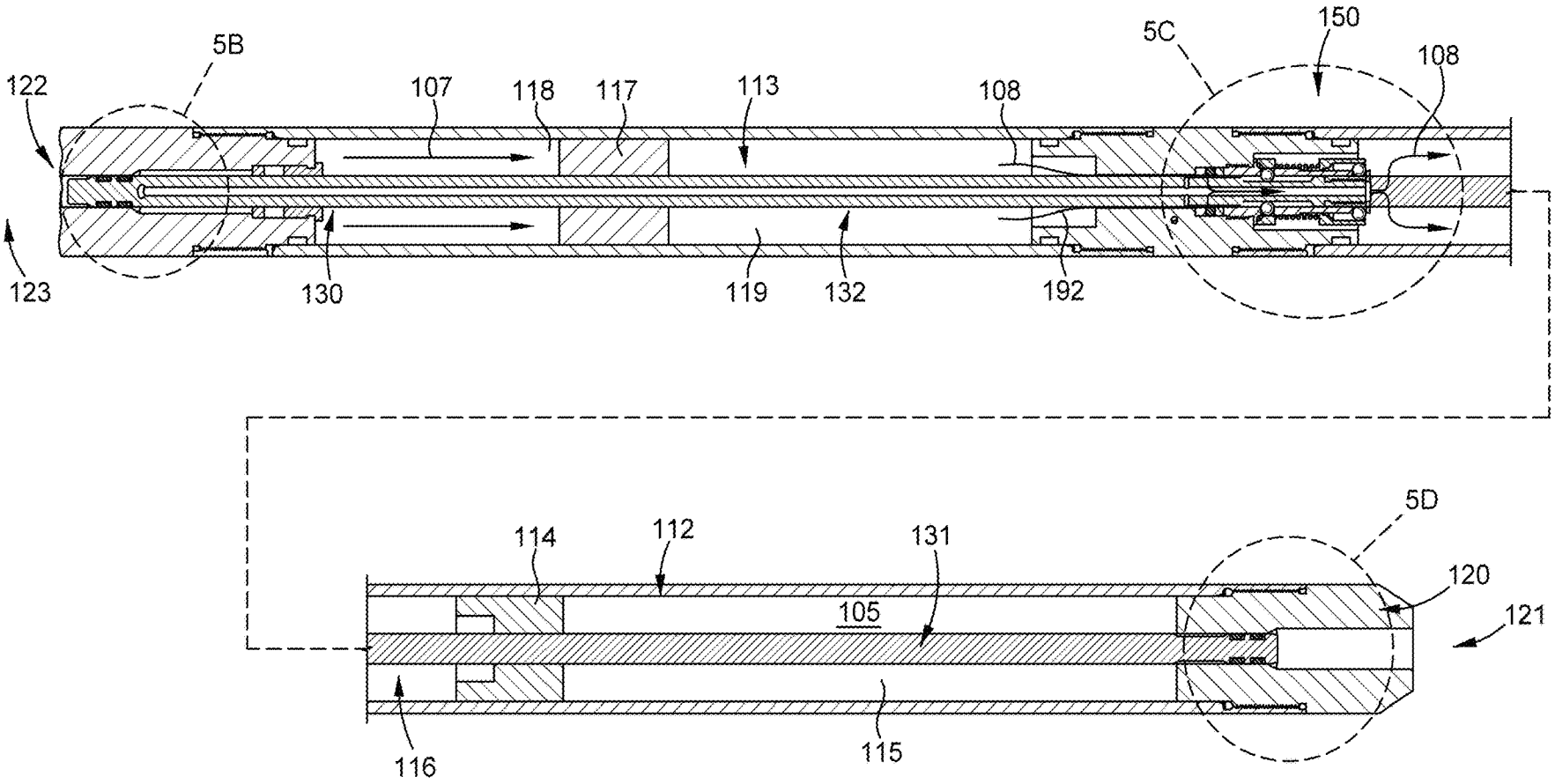
FIG. 5A illustrates a cross-sectional view of the sampling tool of FIG. 2A in the closed configuration while pressurizing, according to one or more embodiments.
Figures 5B, 5C, 5D:
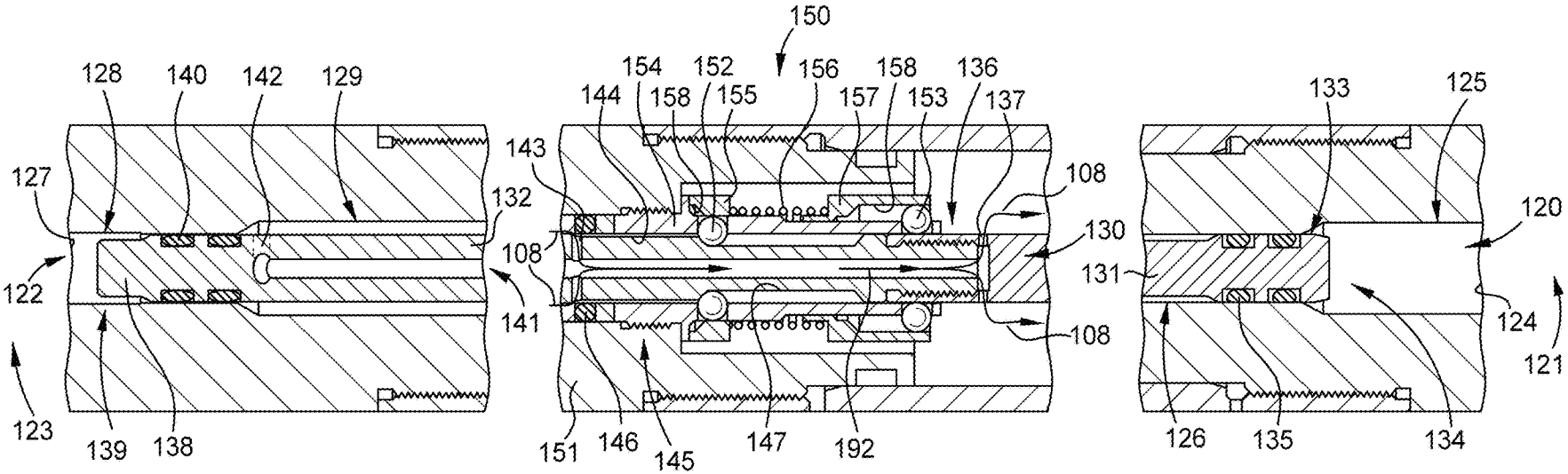
FIG. 5B illustrates a detailed cross-sectional view of a portion of the sampling tool of FIG. 5A, according to one or more embodiments.
FIG. 5C illustrates another detailed cross-sectional view of another portion of the sampling tool of FIG. 5A, according to one or more embodiments.
FIG. 5D illustrates another detailed cross-sectional view of another portion of the sampling tool of FIG. 5A, according to one or more embodiments.

FIG. 1 illustrates a sampling system 100. Sampling system 100 includes a sampling tool 110 deployed in a wellbore 101. The sampling tool 110 may be deployed (e.g. lowered from a surface 102) into the wellbore 101 by a suitable conveyance 103 (e.g. a wireline or coiled tubing). The wellbore 101 extends into a geologic formation 104. The wellbore 101 may contain a wellbore fluid 105. The sampling tool 110 may be used to retrieve a sample of wellbore fluid 105 for analysis during a wellbore operation. Upon retrieval of the sample of wellbore fluid 105, the sample may be pumped to the surface 102, or may be returned to the surface 102 within the sampling tool 110 while the sampling tool 110 is retrieved by the suitable conveyance 103.

FIGS. 2A-2D illustrate cross-sectional views of the sampling tool 110. The sampling tool 110 includes a housing 111 including a sampling chamber 112 and a pressurized chamber 113. In some embodiments, the pressurized chamber 113 is remote to the sampling tool 110.

In some embodiments, the sampling chamber 112 may be segmented by a sample piston 114 movable within the sampling chamber 112. In such embodiments, the sample piston 114 segments the sampling chamber into a first portion 115 and a second portion 116 that are fluidly isolated from one another. That is, the sample piston 114 prevents fluid from flowing from one side of the sample piston 114 to the other side of the sample piston 114 within the sampling chamber 112. The sample piston 114 is movable within the sampling chamber 112 such that the volume of the first portion 115 of the sampling chamber 112 and the volume of the second portion 116 of the sampling chamber 112 may vary. The volume of the first portion 115 of the sampling chamber 112 and is inversely proportional to the volume of the second portion 116 of the sampling chamber 112. That is, as the volume of the first portion 115 of the sampling chamber 112 increases, the volume of the second portion 116 of the sampling chamber 112 decreases and vice versa. The first portion 115 of the sampling chamber 112 is intended to collect and store a sample of wellbore fluid 105 and the second portion 116 of the sampling chamber 112 contains a buffer fluid 106.

In some embodiments, the pressurized chamber 113 may be segmented by a pressure piston 117 movable within the pressurized chamber 113. In such embodiments, the pressure piston 117 segments the pressurized chamber 113 into a first portion 118 and a second portion 119 that are fluidly isolated from one another. That is, the pressure piston 117 prevents fluid from flowing from one side of the pressure piston 117 to the other side of the pressure piston 117. The pressure piston 117 is movable within the pressurized chamber 113 such that the volume of the first portion 118 of the pressurized chamber 113 and the volume of the second portion 119 of the pressurized chamber 113 may vary. The volume of the first portion 118 of the pressurized chamber 113 and is inversely proportional to the volume of the second portion 119 of the pressurized chamber 113. That is, as the volume of the first portion 118 of the pressurized chamber 113 increases, the volume of the second portion 119 of the pressurized chamber 113 decreases and vice versa. The first portion 118 of the pressurized chamber 113 is intended to contain a pressurized fluid (e.g. a pressurized gas or liquid) 107 and the second portion 119 of the pressurized chamber 113 contains a second buffer fluid 108. The pressurized fluid 107 may be nitrogen gas, air, or other gas.

The housing 111 further includes an inlet 120 at its downhole end 121. The housing includes an outlet 122 at its uphole end 123. The inlet 120 is selectively in fluid communication with the first portion 115 of the sampling chamber 112. The outlet 122 is selectively in fluid communication with the second portion 116 of the sampling chamber 112.

The inlet 120 includes one or more ports 124 that extend through the housing 111 into the environment. The inlet 120 also includes an inlet cavity 125 with an enlarged inner diameter. Additionally, the inlet 120 includes a sampling chamber inlet 126 with a narrower inner diameter than that of the inlet cavity 125. Thus, when fluid communication is allowed from the inlet 120 to the first portion 115 of the sampling chamber 112, fluid flows through the one or more ports 124, into the inlet cavity 125, and into the first portion 115 of the sampling chamber 112 through the sampling chamber inlet 126.

The outlet 122 includes a one or more ports 127 that fluidly couple the sampling tool 110 to other equipment of the sampling operation, such as hydraulic lines. The outlet 122 includes a first outlet cavity 128. Additionally, the outlet 122 includes a second outlet cavity 129 with a larger diameter than the first outlet cavity 128. Thus, when fluid communication is allowed between the second portion 116 of the sampling chamber 112 and the outlet 122, fluid flows from the second portion 116 of the sampling chamber 112 to the second outlet cavity 129, through the first outlet cavity 128, and out of the sampling tool 110 through the one or more ports 127.

The sampling tool 110 further includes a rod 130 disposed in the housing 111 including a first rod portion 131 coupled to a second rod portion 132. The rod 130 is axially movable within the housing 111. In some embodiments, the first rod portion 131 and the second rod portion 132 are integral to one another. The first rod portion 131 and the second rod portion 132 may be coupled to one another by, for example by a threaded connection. The first rod portion 131 is at least partially disposed in the sampling chamber 112 and the second rod portion 132 is at least partially disposed in the pressurized chamber 113.

The first rod portion 131 includes an inlet head 133 with an increased diameter at its downhole end 134. The inlet head 133 is surrounded by one or more seals 135. The inlet head 133 is sized so that when it is disposed in the inlet cavity 125, fluid is able to flow around the inlet head 133 and into the sampling chamber 112 through the sampling chamber inlet 126. However, the inlet head 133 is sized so that, when the inlet head 133 is disposed in the sampling chamber inlet 126, the one or more seals 135 seal against the sampling chamber inlet 126 and fluid flow is blocked from flowing into the sampling chamber 112 through the sampling chamber inlet 126.

A portion of the first rod portion 131 is disposed within the sampling chamber 112. In embodiments including the sample piston 114, the sample piston 114 is disposed about the first rod portion 131 in the sampling chamber 112 and is permitted to slide along the first rod portion 131 within the sampling chamber 112.

The uphole end 136 of the first rod portion 131 includes one or more ports 137 fluidly coupling the second portion 116 of the sampling chamber 112 and to the interior of the rod 130 (e.g. a bore 141 of the second rod portion 132).

The second rod portion 132 includes an outlet head 138 at its uphole end 139 with an increased diameter. The outlet head 138 is surrounded by one or more seals 140. The outlet head 138 is sized so that when it is disposed in the second outlet cavity 129, fluid flow is able to flow around the outlet head 138 and through the first outlet cavity 128 and out of the sampling tool 110 through the one or more ports 127. However, the outlet head 138 is sized so that, when the outlet head 138 is disposed in the first outlet cavity 128, the one or more seals 140 seal against the first outlet cavity 128 and fluid flow is blocked from flowing out of the sampling tool 110.

The second rod portion 132 also includes a bore 141 disposed partially through the second rod portion 132. The bore 141 terminates before extending through the uphole end 139, but extends through to, at least, the one or more ports 137 of the first rod portion 131. The second rod portion 132 also includes one or more ports 142 extending through the outer surface 144 of the second rod portion 132 and into the bore 141 on the downhole side of the outlet head 138. Thus, the bore 141 is in fluid communication with the second outlet cavity 129. Similarly, the second portion 116 of the sampling chamber 112 is in fluid communication with the second outlet cavity 129 through the one or more ports 137, the bore 141, and the one or more ports 142.

A portion of the second rod portion 132 is disposed within the pressurized chamber 113. In embodiments including the pressure piston 117, the pressure piston 117 is disposed about the second rod portion 132 in the pressurized chamber 113 and is permitted to slide along the second rod portion 132 within the pressurized chamber 113.

The second rod portion 132 further includes a cross-drill 143 extending from an outer surface 144 of the second rod portion 132 to the bore 141 of the second rod portion 132 near its downhole end 145. The diameter of the second rod portion 132 on the uphole side of the cross-drill 143 is larger than the diameter of the second rod portion 132 on the downhole side of the cross-drill 143.

A sealing barrier 146 is disposed about in the housing 111 about the second rod portion 132 fluidly isolating the second portion 119 of the pressurized chamber 113 from the cross-drill 143. The sealing barrier 146 may be any pressure barrier including, but not limited to, a seal, an O-ring, a T-seal, a spring-energized sealing barrier, and/or any combination thereof. For brevity, sealing barrier 146 will be referred to hereinafter as "seal 146." The seal 146 is sized so that the portion of the second rod portion 132 uphole of the cross-drill 143 seals against the seal 146. However, when the rod 130 is moved so that the decreased diameter of the portion of the second rod portion 132 that is downhole of the cross-drill 143 is aligned with the seal 146, the seal is broken and fluid flow is allowed through the cross-drill 143 and into the bore 141 of the second rod portion 132. In some embodiments, the second rod portion 132 is a consistent diameter and fluid communication is opened by the cross-drill crossing under the seal 146. In some embodiments, the seal 146 is damaged when the cross-drill 143 crosses the seal 146.

The second rod portion 132 includes a groove 147. The groove 147 is located between the sampling chamber 112 and the pressurized chamber 113 and between the one or more ports 137 and the cross-drill 143.

As previously mentioned, the rod 130 is axially movable within the housing 111. The rod 130 is movable between a first position, shown in FIGS. 2A-3D, and a second position, shown in FIGS. 4A-5D. The first position is the open, or sampling, position. The second position is the closed and pressurizing, position.

When the rod 130 is in the first position, fluid communication is opened between the first portion 115 of the sampling chamber 112 and the wellbore 101 through the one or more ports 124, the inlet cavity 125, and the sampling chamber inlet 126. When the rod 130 is in the first position, fluid communication is opened between the outlet 122 and the second portion 116 of the sampling chamber 112 through the one or more ports 137, the bore 141, the one or more ports 142, the second outlet cavity 129, the first outlet cavity 128, and the one or more ports 127. When the rod 130 is in the first position, fluid communication is blocked between the second portion 119 of the pressurized chamber 113 and the second portion 116 of the sampling chamber 112.

When the rod 130 is axially shifted uphole to the second position, fluid communication is blocked between the inlet 120 and the first portion 115 of the sampling chamber 112 and between the second portion 116 of the sampling chamber 112 and the outlet 122. However, in the second position, fluid communication between the second portion 119 of the pressurized chamber 113 and the second portion 116 of the sampling chamber 112 is opened through the cross-drill 143, the bore 141, and the one or more ports 137.

A lock mechanism 150 is disposed in the sampling tool 110 between the sampling chamber 112 and the pressurized chamber 113. The lock mechanism 150 is positioned about the rod 130 such that the rod 130 may move axially through the lock mechanism 150.

The lock mechanism 150 is mounted to the interior of the housing 111 by a mounting structure 151. The lock mechanism includes a first locking member 153 and a second locking member 152. The first locking member 153 and second locking member 152 are engagable with the groove 147 of the rod 130 to hold the rod in certain positions. In some embodiments, the first locking member 153 and the second locking member 152 are ball bearings. In some embodiments, the first locking member 153 and the second locking member 152 are dogs.

The locking mechanism 150 further includes a locking member cage 154, a first collar 157, a bias spring 156, and a second collar 155.

The locking member cage 154 is coupled to the mounting structure 151 by, for example, threads. The locking member cage 154 retains the first locking member 153 and the second locking member 152 axially spaced from one another while allowing radial movement of the first locking member 153 and the second locking member 152.

The first locking member 153 and the second locking member 152 are engagble with the groove 147 of the rod 130. The first locking member 153 and the second locking member 152 are retained axially spaced by the locking member cage 154 such that only one of the first locking member 153 and the second locking member 152 is engagble with the groove 147. That is, the locking member cage 154 retains the first locking member 153 from the second locking member 152 at a distance larger than the length of the groove 147.

The first collar 157 radially retains the first locking member 153 and the second collar 155 radially retains the second locking member 152. The first collar 157 and the second collar 155 are biased axially away from one another by the bias spring 156 which is disposed between them.

The first collar 157 and the second collar 155 include internal surfaces 158, such as stepped or sloped surfaces, that permit the first locking member 153 and the second locking member 152 to be retained at different radial positions, such as the radial position when engaged with the groove 147 and the radial position when engaged with the un-grooved portion of the rod 130.

As will be further described later, when the rod 130 is in the first position, the first locking member 153 is disposed in, and engaged with, the groove 147 and the second locking member 152 is disposed on, and engaged with, the un-grooved portion of the rod 130. Whereas, when the rod 130 is in the second position, the second locking member 152 is disposed in, and engaged with, the groove 147 and the first locking member 153 is disposed on, and engaged with, the un-grooved portion of the rod 130. When the rod 130 is in the first position, the locking mechanism 150 retains the rod 130 in the first position and when the rod 130 is in the second position, the locking mechanism 150 retains the rod 130 in the second position.

When the rod 130 is in the first position, the length and position of the groove 147 also permits sufficient forward axial motion (e.g. downhole motion) of the rod 130 to maintain a pressure balance between the downhole end 121 of the first rod portion 131 and the uphole end 139 of the second rod portion 132 when the rod 130 is in the first position. However, the length and position of the groove 147 prevents rearward axial motion (e.g. uphole motion) sufficient to move the rod 130 into the second position (e.g. the closed position) to prematurely close the sampling tool 110.

Similarly, when the rod 130 is in the second position, the length of the groove 147 permits the rearward axial motion (e.g. uphole motion) of the rod 130, but prevents forward axial motion (e.g. downhole motion) sufficient to move the rod 130 back into the first position (e.g. the open position) to reopen the sampling tool 110.

FIGS. 3A-3D illustrate the sampling tool 110 in the sampling configuration. In the sampling configuration, the rod 130 is in the first position and is held in the first position by the locking mechanism 150.

In some embodiments, the sampling configuration is the run-in configuration. In such embodiments, the sampling tool 110 run-in by a suitable conveyance 103 and is held in the sampling configuration with the first portion 115 of the sampling chamber 112 empty to receive a sample of wellbore fluid 105, the second portion 116 of the sampling chamber 112 full of buffer fluid 106, the first portion 118 of the pressurized chamber 113 full of pressurized fluid 107, and the second portion 119 of the pressurized chamber 113 full of a second buffer fluid 108. In some embodiments, the buffer fluid 106 and second buffer fluid 108 are the same fluids, in some embodiments, the buffer fluid 106 and the second buffer fluid 108 are different fluids. In some embodiments, the sampling tool may not include a sample piston 114 or a pressure piston 117 and may not include one or more of the buffer fluid 106 and the second buffer fluid 108.

In the sampling configuration, the rod 130 is in the first position. In the first position, the rod 130 is axially positioned such that the inlet head 133 of the first rod portion 131 is disposed in the inlet cavity 125, the first locking member 153 is disposed in the groove 147, and the outlet head 138 of the second rod portion 132 is disposed in the second outlet cavity 129.

In said position, fluid communication is allowed between the wellbore 101 external the tool and the first portion 115 of the sampling chamber 112 through a first flow path 190. Similarly, in said position, fluid communication is allowed between the second portion 116 of the sampling chamber 112 and outlet 122 of the sampling tool 110 through a second flow path 191.

The first flow path 190 allows the first portion 115 of the sampling chamber 112 to fill with wellbore fluid 105. The first flow path 190 allows wellbore fluid 105 to flow into the one or more ports 124, through the inlet cavity 125 and around the inlet head 133 of the first rod portion 131, through the sampling chamber inlet 126, and into the first portion 115 of the sampling chamber 112. As the first portion 115 of the sampling chamber 112 fills with wellbore fluid 105, the sample piston 114 is moved, exerting a pressure on the buffer fluid 106 in the second portion 116 of the sampling chamber 112.

The second flow path 191 allows the buffer fluid 106 to flow out of the outlet 122 of the sampling tool 110. As the wellbore fluid 105 causes the sample piston 114 to pressurize the buffer fluid 106, the second flow path 191 allows the buffer fluid 106 to flow out of the second portion 116 of the sampling chamber 112 through the one or more ports 137 of the first rod portion 131 and into the bore 141 of the second rod portion 132, out of the one or more ports 142 of the second rod portion 132 of the rod and into the second outlet cavity 129, around the outlet head 138 of the second rod portion 132, into the first outlet cavity 128, and out of the one or more ports 127 of the outlet 122 of the sampling tool 110.

In the first position, fluid communication between the bore 141 and the second portion 119 of the pressurized chamber is blocked. That is, the cross-drill 143 through the rod 130 is disposed on the downhole side of the seal 146, thus, fluid communication from the second portion 119 of the pressurized chamber 113 and the cross-drill 143 is blocked.

When the rod 130 is in the first position, the rod 130 is held in the first position by the locking mechanism 150. The first locking member 153 is retained in the groove 147 of the rod 130 by the first collar 157 and the second locking member 152 is engaged with and disposed on the outer surface 144 of the rod 130 uphole of the groove 147. With the first locking member 153 retained in the groove 147, the rod 130 is prevented from moving in the uphole direction sufficient to close the sampling tool 110 prematurely FIGS. 4A-4D illustrate the sampling tool 110 in the closed configuration. In the closed configuration, the rod 130 is in the second position. FIGS. 4A-4D only illustrates the closed configuration while FIGS. 5A-5D illustrate the sampling tool 110 pressurizing the sample while in the closed configuration. In practice, the configuration of FIGS. 4A-4D and the operation of FIGS. 5A-5D may happen simultaneously. For the sake of clarity, the closing step (shown in FIGS. 4A-4D) and the pressurizing step (shown in FIGS. 5A-5D) will be described separately.

In FIGS. 4A-4D, the sample piston 114 has been moved to the end of the sampling chamber 112 such that the entirety of the sampling chamber 112 is now the first portion 115 and is full of wellbore fluid 105. With the sampling chamber 112 full of wellbore fluid 105, the sample piston 114 comes to abut the locking mechanism 150, such that a portion of the sample piston 114 abuts the first collar 157 of the locking mechanism 150. As the sample piston 114 engages with the first collar 157, the first collar 157 is moved uphole relative to the locking member cage 154 and the second collar 155 while the bias spring 156 is compressed. As the first collar 157 is moved, the first locking member 153 is radially freed and allowed to move along the stepped and/or slopped internal surfaces 158 of the first collar 157 to radially expand an disengage from the groove 147. With the first locking member 153 disengaged from the groove 147, the rod 130 may move in the uphole direction. As the rod 130 moves in the uphole direction, the one or more seals 135 disposed on the downhole end 121 of the first rod portion 131 engage with and seal against sampling chamber inlet 126 to close first flow path 190. Similarly, as the rod 130 moves in the uphole direction, the one or more seals 140 disposed on the uphole end 139 of the second rod portion 132 engage with and seal against the first outlet cavity 128 to close second flow path 191. Also, as the rod 130 moves in the uphole direction, the second locking member 152 engages with the groove 147 and is retained in the groove 147 by the second collar 155. Finally, as the rod 130 moves in the uphole direction, the cross-drill 143 passes underneath the seal 146 thus opening fluid communication between the second portion 119 of the pressurized chamber 113 and the second portion 116 of the sampling chamber 112 through the cross-drill 143, the bore 141, and the one or more ports 137.

FIGS. 5A-5D illustrate the sampling tool 110 with the rod 130 in the second position. That is, the closed and pressurizing position. As mentioned above, when the rod 130 is moved to the second position, fluid communication between the wellbore 101 and the first portion 115 of the sampling chamber 112 is closed and fluid communication between the second portion 116 of the sampling chamber 112 and the outlet 122 is closed. However, fluid communication between the second portion 119 of the pressurized chamber 113 and the second portion 116 of the sampling chamber 112 is opened along flow path 192.

Flow path 192 allows the second buffer fluid 108 to flow from the second portion 119 of the pressurized chamber 113, through the cross-drill 143, through the bore 141, through the one or more ports 137 of the first rod portion 131, and into the second portion 116 of the sampling chamber 112.

When the flow path 192 is opened, the pressurized fluid 107 acts on the uphole side of the pressure piston 117 to push the second buffer fluid 108 into the second portion 116 of the sampling chamber 112 to pressurize the uphole side of the sample piston 114 and pressurize the sample of wellbore fluid 105 in the first portion of 115 of the sampling chamber 112. Therefore, the pressure and compressibility of the pressurized fluid 107 determines the amount that the sample of wellbore fluid 105 in the first portion 115 of the sampling chamber 112 is pressurized.

With the sample of the wellbore fluid 105 in the first portion 115 of the sampling chamber 112 pressurized, the sampling tool 110 may be returned to the surface 102 for sample retrieval and analysis.

Figure 6:
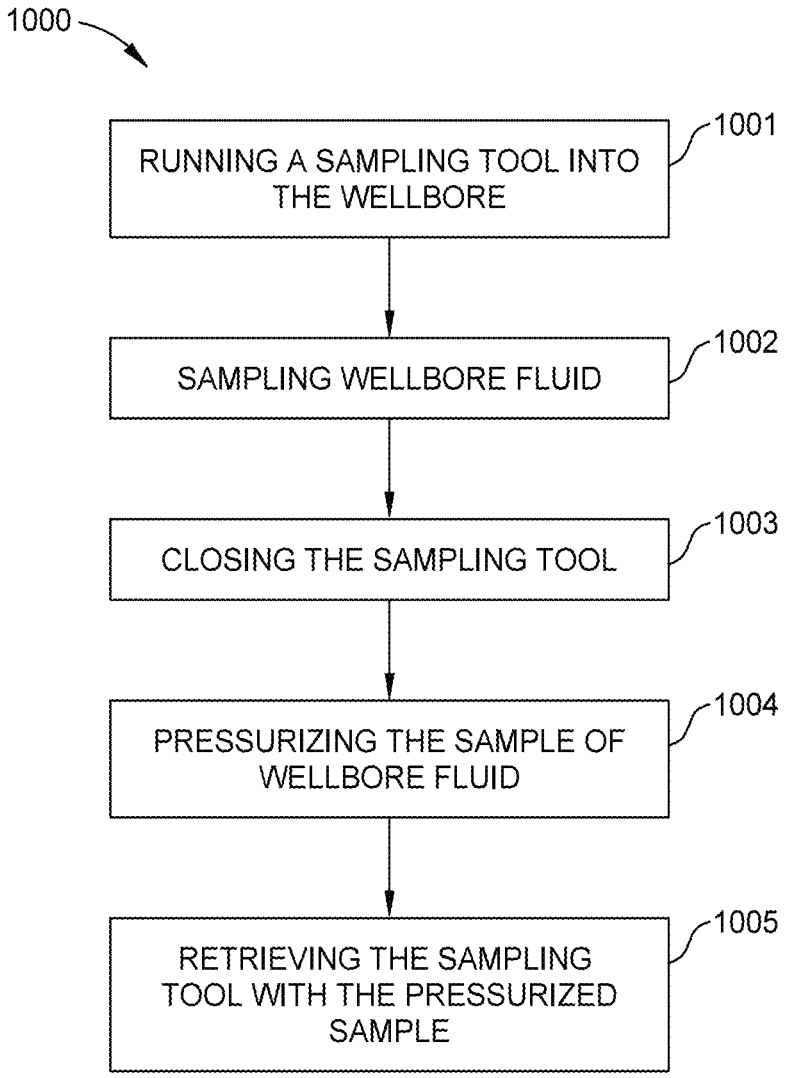
FIG. 6 illustrates a method for sampling wellbore fluid, according to one or more embodiments.

FIG. 6 illustrates a method 1000 for sampling a wellbore fluid (such as wellbore fluid 105 of FIG. 1).

At step 1001, a sampling tool (such as sampling tool 110 of FIGS. 2A-5D) is lowered into a wellbore (such as wellbore 101 of FIG. 1) by a suitable conveyance (such as suitable conveyance 103 of FIG. 1). While the sampling tool is being lowered into the wellbore, the sampling tool may be in the open configuration. While in the open configuration, the rod (such as rod 130 of FIGS. 2A-5D) is in a first axial position, as illustrated in FIGS. 2A-3D. When the rod is in the first axial position, a first flow path (such as first flow path 190 of FIGS. 3A-3B) between the wellbore and a first portion (such as first portion 115 of FIGS. 2A-5D) of a sampling chamber (such as sampling chamber 112 of FIGS. 2A-5D) is open, thus allowing wellbore fluid to enter the first portion of the sampling chamber. The first flow path flows from the wellbore, through one or more ports (such as one or more ports 124 of FIGS. 2A-5D) of an inlet (such as inlet 120 of FIGS. 2A-5D), around an inlet head (such as inlet head 133 of FIGS. 2A-5D) of the rod disposed in an inlet cavity (such as inlet cavity 125 of FIGS. 2A-5D), through and through a sampling chamber inlet (such as sampling chamber inlet 126 of FIGS. 2A-5D) and into the first portion of the sampling chamber.

Further, when the rod is in the first position, a second flow path (such as second flow path 191 of FIGS. 3A-3D) between a second portion (such as second portion 116 of FIGS. 2A-5D) of the sampling chamber and an outlet (such as outlet 122 of FIGS. 2A-5D) of the sampling tool is also opened allowing a buffer fluid (such as buffer fluid 106 of FIGS. 2A-3D) to flow out of the sampling tool. The second flow path flows from the second portion of the sampling chamber, through one or more ports (such as one or more ports 137 of FIGS. 2A-5D) of the rod, into a bore (such as bore 141 of FIGS. 2A-5D) disposed in the rod, out of the bore through one or more ports (such as one or more ports 142 of FIGS. 2A-5D) of the rod, into a second outlet cavity (such as second outlet cavity 129 of FIGS. 2A-5D), around an outlet head (such as outlet head 138 of FIGS. 2A-5D) of the rod disposed in a first outlet cavity (such as first outlet cavity 128 of FIGS. 2A-5D), and out of the outlet of the sampling tool.

The rod is held in the first position by a locking mechanism (such as locking mechanism 150). A first locking member (such as first locking member 153 of FIGS. 2A-5D) is disposed in, engaged with, and retained in, a groove (such as groove 147 of FIGS. 2A-5D) of the rod. The first locking member is retained in the groove by a first collar (such as first collar 157 of FIGS. 2A-5D). The position and length of the groove prevents the rod from moving uphole a sufficient distance to prematurely close the first and second flow paths, thus prematurely closing the sampling tool. However, the groove is of a sufficient length and position on the rod to allow for pressure differentials between the inlet and the outlet while the sampling tool is being lowered into the wellbore and raised out of the wellbore.

At step 1002, the sampling tool reaches the wellbore fluid to be sampled. The sampling tool intakes a sample of the wellbore fluid into the first portion of the sampling chamber through the first flow path. As the first portion of the sampling chamber fills, the wellbore fluid exerts a pressure onto a sample piston (such as sample piston 114 of FIGS. 2A-5D). The sample piston moves axially within the sampling chamber and reduces the volume of the second portion of the sampling chamber and flows the buffer fluid from the second portion of the sampling chamber out of the outlet of the sampling tool through the second flow path.

At step 1003, the sampling tool is moved to the closed configuration. When the sampling tool is in the closed configuration, the rod is in a second axial position. When the sample piston reaches the end of the sampling chamber, a portion of the sample piston contacts the first collar retaining the first locking member in the groove. As the sample piston contacts the first collar, the first collar is axially moved allowing the first locking member to be freed from engagement with the groove. With the first locking member freed from engagement, the rod is allowed to move uphole.

With the rod freed from engagement with the locking member, the rod moves uphole to the second axial position. In the second position, the first flow path is closed and the second flow path is closed. That is the rod moves uphole and the inlet head shifts to move into the sampling chamber inlet. When the inlet head moves into the sampling chamber inlet, one or more seals (such as one or more seals 135 of FIGS. 2A-5D) disposed around the head, seal against the interior of the sampling chamber inlet to close the first flow path. Similarly, the outlet head moves into the first outlet cavity and one or more seals (such as one or more seals 140 of FIGS. 2A-5D) seal against the interior of the first outlet cavity to close the second flow path.

When the rod moves into the second axial position, the locking mechanism also holds the rod in the second position. As the rod moves into the second position a second locking member (such as second locking member 152 of FIGS. 2A-5D) of the locking mechanism becomes disposed in, engaged with, and retained in the groove of the rod. The second locking member is retained in the groove by a second collar (such as second collar 155 of FIGS. 2A-5D). The position and length of the groove prevents the rod from moving back downhole to reopen the first and second flow paths, thus reopening the sampling tool. However, the groove is of a sufficient length and position on the rod to allow for the rod to move further uphole to engage more of the one or more seals on both heads of the rod.

At step 1004, the collected sample is pressurized. In practice, the sampling tool may close and pressurize simultaneously.

When the rod moves into the second position, a cross-drill (such as cross-drill 143 of FIGS. 2A-5D) in the rod allowing fluid communication between the outer surface of the rod (such as outer surface 144 of FIGS. 2A-5D) and the bore of the rod passes underneath a seal (such as seal 146 of FIGS. 2A-5D). As the cross-drill passes under the seal, the cross-drill enters fluid communication second portion (such as second portion 119 of FIGS. 2A-5D) of a pressurized chamber (such as pressurized chamber 113 of FIGS. 2A-5D) containing a second buffer fluid (such as second buffer fluid 108 of FIGS. 2A-5D). Thus, a third flow path (such as third flow path 192 of FIGS. 5A-5D) is opened between the second portion of the pressurized chamber and the second portion of the sampling chamber. The third flow path flows from the second portion of the pressurized chamber, through the cross-drill and into the bore of the rod, from the bore of the rod and out of one or more ports in the rod (such as one or more ports 137 of FIGS. 2A-5D), and into the second portion of the sampling chamber.

With the third flow path opened, a pressurized fluid (such as pressurized fluid 107 of FIGS. 2A-5D) disposed in a first portion (such as first portion 118 of FIGS. 2A-5D) exerts a pressure onto a pressure piston (such as pressure piston 117 of FIGS. 2A-5D) to flow the second buffer fluid from the second portion of the pressurized chamber to the second portion of the sampling chamber.

As the second buffer fluid fills the second portion of the sampling chamber, the wellbore fluid sample in the now-closed first portion of the sampling chamber is pressurized.

At step 1005, the sampling tool containing the pressurized sample is retrieved to the surface by the suitable conveyance for further analysis.

EXAMPLE ASPECTS

Aspect 1: A method for sampling wellbore fluid, comprising: lowering a sampling tool into a wellbore; configuring the sampling tool in an open configuration, wherein configuring the sampling tool in the open configuration comprises opening fluid communication between a sampling chamber of the sampling tool and the wellbore; retrieving a sample of wellbore fluid from the wellbore in the sampling chamber; retaining the sampling tool in the open configuration with a locking mechanism; configuring the sampling tool in a closed configuration, comprising: closing fluid communication between the sampling chamber and the wellbore; and opening fluid communication between the sampling chamber and a pressurized chamber; retaining the sampling tool in the closed configuration; and pressurizing the sample with a pressurized fluid in the pressurized chamber.

Aspect 2: The method of Aspect 1, wherein configuring the sampling tool in the open configuration comprises positioning a rod of the sampling tool in a first axial position, and wherein configuring the sampling tool in a closed configuration comprises positioning the rod in a second axial position.

Aspect 3: The method of Aspect 2, wherein retaining the sampling tool in the open configuration comprises engaging a groove in the rod with a locking member of the locking mechanism.

Aspect 4: The method of Aspect 3, wherein retaining the sampling tool in the closed configuration comprises engaging the groove in the rod with a second locking member of the locking mechanism.

Aspect 5: The method of any of Aspects 1-4, wherein the pressurized fluid comprises nitrogen gas.

Aspect 6: The method of any of Aspects 1-5, wherein: the sampling chamber is partitioned into a first sampling chamber portion and a second sampling chamber portion by a sample piston; and the sample is retrieved into the first sampling chamber portion Aspect 7: The method of Aspect 6, wherein pressurizing the sample of wellbore fluid comprises applying a pressure from the pressurized fluid onto the sample of wellbore fluid via the sample piston.

Aspect 8: The method of any of Aspects 1-7, wherein: the pressurized chamber is partitioned into a first pressurized chamber portion and a second pressurized chamber portion by a pressure piston; the first pressurized chamber portion includes the pressurized fluid; the second pressurized chamber portion includes a buffer fluid; and opening fluid communication between the sampling chamber and the pressurized chamber comprises opening fluid communication between the sampling chamber and the second pressurized chamber portion.

Aspect 9: The method of Aspect 8, wherein pressurizing the sample of wellbore fluid comprises applying a pressure from the pressurized fluid onto the sample of wellbore fluid via the pressure piston and the buffer fluid.

Aspect 10: A method for sampling wellbore fluid, comprising: lowering a sampling tool into a wellbore, the sampling tool comprising a sampling chamber, a pressurized chamber, a rod partially disposed in the sampling chamber and partially disposed in the pressurized chamber, and a locking mechanism disposed between sampling chamber and the pressurized chamber; opening the sampling chamber, wherein opening the sampling chamber comprises moving the rod to a first position to open fluid communication between the wellbore and the sampling chamber, and wherein when the rod is in the first position, fluid communication between the pressurized chamber and the sampling chamber is blocked and the locking mechanism is in a first configuration retaining the rod in the first position; retrieving a sample of a wellbore fluid; closing the sampling chamber, wherein closing the sampling chamber comprises moving the rod to a second position to close fluid communication between the wellbore and the sampling chamber, and wherein when the rod is in the second position, fluid communication between the pressurized chamber and the sampling chamber is permitted and the locking mechanism is in a second configuration retaining the rod in the second position; and pressurizing the sample of fluid from the wellbore with a pressurized fluid from the pressurized chamber.

Aspect 11: The method of Aspect 10, wherein while the sample is retrieved, a sample piston disposed in the sampling chamber partitioning the sampling chamber into a first sampling chamber portion and a second sampling chamber portion is moved by the sample of wellbore fluid to engage with the locking mechanism, and wherein when the sample piston engages with the locking mechanism, the locking mechanism moves to the second configuration and the rod moves to the second position.

Aspect 12: The method of Aspect 11, wherein the sample is retrieved into the first sampling chamber portion, and wherein moving the sample piston exhausts a buffer fluid disposed in the second sampling chamber portion through an outlet of the tool.

Aspect 13: The method of any of Aspects 11-12, wherein a pressure piston is disposed in and movable within the pressurized chamber, and wherein the pressure piston partitions the pressurized chamber into a first pressurized chamber portion and a second pressurized chamber portion.

Aspect 14: The method of Aspect 13, wherein the first pressurized chamber portion includes the pressurized fluid, and wherein when the rod is in the first position, the second pressurized chamber portion includes a buffer fluid.

Aspect 15: The method of Aspect 14, wherein permitting fluid communication between the pressurized chamber and the sampling chamber comprises permitting fluid communication between the second sampling chamber portion and the second pressurized chamber portion.

Aspect 16: The method of Aspect 15, wherein pressurizing the sample with the pressurized fluid comprises applying a pressure onto the sample via the pressure piston, the buffer fluid, and the sample piston.

Aspect 17: The method of any of Aspects 10-16, further comprising retrieving the sampling tool containing the pressurized sample.

Aspect 18: A wellbore fluid sampling tool, comprising: a sampling chamber in selective fluid communication with a pressurized chamber, a rod disposed in the tool, wherein the rod is movable between a first position and a second position, and a 2 position rod locking mechanism disposed between the chambers, wherein in a first locking position the rod is retained in the first position, and in a second locking position, the rod is retained in the second position. When the rod is in the first position, the sampling chamber is open to wellbore fluid and fluid communication between the chambers is closed. When the rod is in the second position, the sampling chamber is closed to wellbore and fluid communication between the chambers is open.

Aspect 19: The wellbore fluid sampling tool of Aspect 18, wherein in the first locking position, a first engagement member is engaged with a groove in the rod.

Aspect 20: The wellbore fluid sampling tool of any of Aspects 18-19, wherein in the second locking position, a second engagement member is engaged with a groove in the rod.

Any one or more components of sampling tool 110 may be integrally formed together, directly coupled together, and/or indirectly coupled together and are not limited to the specific arrangement of components illustrated in FIGS. 1-5D. Any one or more of the embodiments of the sampling tool 110 may be combined in whole or part with any one or more of the embodiments of the sampling tool 110.

While the present disclosure has been described with respect to a number of embodiments and examples, those skilled in the art, having benefit of this disclosure, will appreciate that other embodiments can be devised which do not depart from the scope and spirit of the present disclosure.

It will be appreciated by those skilled in the art that the preceding embodiments are exemplary and not limiting. It is intended that all modifications, permutations, enhancements, equivalents, and improvements thereto that are apparent to those skilled in the art upon a reading of the specification and a study of the drawings are included within the scope of the disclosure. It is therefore intended that the following appended claims may include all such modifications, permutations, enhancements, equivalents, and improvements. The disclosure also contemplates that one or more aspects of the embodiments described herein may be substituted in for one or more of the other aspects described. The scope of the disclosure is determined by the claims that follow.

What is claimed is:

1. A method for sampling wellbore fluid, comprising:

lowering a sampling tool into a wellbore;

configuring the sampling tool in an open configuration by shifting a sampling rod extending through the sampling tool to a first position, wherein configuring the sampling tool in the open configuration comprises opening fluid communication between a sampling chamber of the sampling tool and the wellbore, and wherein, in the first position, a bore extending through the sampling rod is in fluid communication with the sampling chamber through a first opening in the sampling rod;

retrieving a sample of wellbore fluid from the wellbore in the sampling chamber;

retaining the sampling tool in the open configuration with a locking mechanism;

configuring the sampling tool in a closed configuration by shifting the sampling rod to a second position, comprising:

closing fluid communication between the sampling chamber and the wellbore; and opening fluid communication between the sampling chamber and a pressurized chamber, wherein opening fluid communication between the sampling chamber and the pressurized chamber comprises opening fluid communication from the pressurized chamber, through a second opening in the sampling rod into the bore of the sampling rod, out of the first opening, and into the sampling chamber;

retaining the sampling tool in the closed configuration; and pressurizing the sample with a pressurized fluid in the pressurized chamber.

2. The method of claim 1, wherein retaining the sampling tool in the open configuration comprises engaging a groove in the sampling rod with a locking member of the locking mechanism.

3. The method of claim 2, wherein retaining the sampling tool in the closed configuration comprises engaging the groove in the sampling rod with a second locking member of the locking mechanism.

4. The method of claim 1, wherein the pressurized fluid comprises nitrogen gas.

5. The method of claim 1, wherein:

the sampling chamber is partitioned into a first sampling chamber portion and a second sampling chamber portion by a sample piston; and the sample is retrieved from the wellbore into the first sampling chamber portion.

6. The method of claim 5, wherein pressurizing the sample of wellbore fluid comprises applying a pressure from the pressurized fluid onto the sample of wellbore fluid via the sample piston.

7. The method of claim 1, wherein:

the pressurized chamber is partitioned into a first pressurized chamber portion and a second pressurized chamber portion by a pressure piston;

the first pressurized chamber portion includes the pressurized fluid;

the second pressurized chamber portion includes a buffer fluid; and opening fluid communication between the sampling chamber and the pressurized chamber comprises opening fluid communication between the sampling chamber and the second pressurized chamber portion.

8. The method of claim 7, wherein pressurizing the sample of wellbore fluid comprises applying a pressure from the pressurized fluid onto the sample of wellbore fluid via the pressure piston and the buffer fluid.

9. The method of claim 1, wherein opening fluid communication from the pressurized chamber, through the second opening in the sampling rod into the bore of the sampling rod, out of the first opening, and into the sampling chamber includes damaging a seal disposed about the sampling rod.

10. A method for sampling wellbore fluid, comprising:

lowering a sampling tool into a wellbore, the sampling tool comprising a sampling chamber, a pressurized chamber, a sampling rod partially disposed in the sampling chamber and partially disposed in the pressurized chamber, and a locking mechanism disposed between sampling chamber and the pressurized chamber;

opening the sampling chamber, wherein opening the sampling chamber comprises moving the sampling rod to a first position to open fluid communication between the wellbore and the sampling chamber, and wherein when the sampling rod is in the first position:

fluid communication between the pressurized chamber and the sampling chamber is blocked;

a bore extending through the sampling rod is in fluid communication with the sampling chamber through a first opening in the sampling rod; and the locking mechanism is in a first configuration retaining the sampling rod in the first position;

retrieving a sample of a wellbore fluid;

closing the sampling chamber, wherein closing the sampling chamber comprises moving the sampling rod to a second position to close fluid communication between the wellbore and the sampling chamber, and wherein when the sampling rod is in the second position:

fluid communication between the pressurized chamber and the sampling chamber is permitted, wherein permitting the fluid communication between the pressurized chamber and the sampling chamber includes opening fluid communication from the pressurized chamber, through a second opening in the sampling rod, into the bore of the sampling rod, out of the first opening in the sampling rod, and into the sampling chamber; and the locking mechanism is in a second configuration retaining the sampling rod in the second position; and pressurizing the sample of fluid from the wellbore with a pressurized fluid from the pressurized chamber.

11. The method of claim 10, wherein while the sample is retrieved, a sample piston disposed in the sampling chamber partitioning the sampling chamber into a first sampling chamber portion and a second sampling chamber portion is moved by the sample of wellbore fluid to engage with the locking mechanism, and wherein when the sample piston engages with the locking mechanism, the locking mechanism moves to the second configuration and the sampling rod moves to the second position.

12. The method of claim 11, wherein the sample is retrieved from the wellbore into the first sampling chamber portion, and wherein moving the sample piston exhausts a buffer fluid disposed in the second sampling chamber portion through an outlet of the tool.

13. The method of claim 11, wherein a pressure piston is disposed in and movable within the pressurized chamber, and wherein the pressure piston partitions the pressurized chamber into a first pressurized chamber portion and a second pressurized chamber portion.

14. The method of claim 13, wherein the first pressurized chamber portion includes the pressurized fluid, and wherein when the sampling rod is in the first position, the second pressurized chamber portion includes a buffer fluid.

15. The method of claim 14, wherein permitting fluid communication between the pressurized chamber and the sampling chamber comprises permitting fluid communication between the second sampling chamber portion and the second pressurized chamber portion.

16. The method of claim 15, wherein pressurizing the sample with the pressurized fluid comprises applying a pressure onto the sample via the pressure piston, the buffer fluid, and the sample piston.

17. The method of claim 10, further comprising retrieving the sampling tool containing the pressurized sample.

18. A wellbore fluid sampling tool, comprising:

a sampling chamber in selective fluid communication with a pressurized chamber;

a sampling rod disposed in the tool, the sampling rod including a bore, a first opening extending between an outer surface of the sampling rod and the bore, and a second opening extending between the outer surface of the sampling rod and the bore, wherein the sampling rod is movable between a first position and a second position, and wherein, in the first position:

the sampling chamber is open to wellbore fluid;

fluid communication between the sampling chamber and the bore of the sampling rod is open through the first opening; and fluid communication between the chambers is closed; and wherein, in the second position:

the sampling chamber is closed to wellbore; and fluid communication is opened from the pressurized chamber, through the second opening in the sampling rod, into the bore of the sampling rod, out of the first opening in the sampling rod, and into the sampling chamber; and a sampling rod locking mechanism disposed between the chambers, wherein in a first locking position the sampling rod is retained in the first position, and in the second locking position, the sampling rod is retained in the second position.

19. The wellbore fluid sampling tool of claim 18, wherein in the first locking position, a first engagement member is engaged with a groove in the sampling rod.

20. The wellbore fluid sampling tool of claim 19, wherein in the second locking position, a second engagement member is engaged with a groove in the sampling rod.

* * * * *